US007520734B2

(12) United States Patent
Luedtke et al.

(10) Patent No.: US 7,520,734 B2
(45) Date of Patent: Apr. 21, 2009

(54) ELECTRICALLY DRIVEN AIR PUMP AND METHOD FOR THE PRODUCTION THEREOF

(75) Inventors: Ulrich Luedtke, Karlsruhe-Durlach (DE); Claudius Muschelknautz, Buehl (DE); Fabrice Burg, Offendorf (FR)

(73) Assignee: Robert Bosch GmbH (DE)

( * ) Notice: Subject to any disclaimer, the term of this patent is extended or adjusted under 35 U.S.C. 154(b) by 309 days.

(21) Appl. No.: 10/539,657

(22) PCT Filed: Nov. 7, 2003

(86) PCT No.: PCT/DE03/03678

§ 371 (c)(1),
(2), (4) Date: Jun. 14, 2005

(87) PCT Pub. No.: WO2004/057195

PCT Pub. Date: Jul. 8, 2004

(65) Prior Publication Data

US 2006/0115368 A1 Jun. 1, 2006

(30) Foreign Application Priority Data

Dec. 18, 2002 (DE) ..... 102 59 179

(51) Int. Cl.
*F04B 35/04* (2006.01)

(52) U.S. Cl. ..... 417/423.1

(58) Field of Classification Search ..... 417/423.15, 417/423.1, 423.14, 423.7; 416/144; 415/199.1, 415/199.2

See application file for complete search history.

(56) References Cited

U.S. PATENT DOCUMENTS

| | | | | |
|---|---|---|---|---|
| 1,603,076 | A | | 10/1926 | Hanson |
| 2,809,590 | A | * | 10/1957 | Brown ..... 417/357 |
| 5,235,228 | A | * | 8/1993 | Nakanura et al. ..... 310/51 |
| 5,487,640 | A | * | 1/1996 | Shaffer ..... 415/119 |
| 5,639,228 | A | * | 6/1997 | Van De Venne et al. . 417/423.14 |
| 5,711,652 | A | * | 1/1998 | Van De Venne et al. ..... 416/144 |
| 5,738,503 | A | * | 4/1998 | Schmidt-Marloh et al. ..... 417/423.7 |

FOREIGN PATENT DOCUMENTS

| | | |
|---|---|---|
| DE | 41 07 049 | 9/1992 |
| EP | 0 470 265 | 2/1992 |
| EP | 0 711 924 | 5/1996 |
| GB | 2 275 968 | 9/1994 |
| WO | 00/72740 | 12/2000 |

* cited by examiner

*Primary Examiner*—Devon C Kramer
*Assistant Examiner*—Alexander B Comley
(74) *Attorney, Agent, or Firm*—Michael Best & Friedrich LLP

(57) ABSTRACT

A method to manufacture a secondary air pump for a motor vehicle with an internal combustion engine, wherein the air pump features a housing, in which a pump mechanism with at least one fan wheel as well as an electric motor driving the at least one fan wheel are arranged. The air pump is counterbalanced with the electric motor built into the housing via balancing in at least two planes that are spaced apart axially.

8 Claims, 2 Drawing Sheets

ELECTRICALLY DRIVEN AIR PUMP AND METHOD FOR THE PRODUCTION THEREOF

BACKGROUND OF THE INVENTION

The invention relates to a method to manufacture an electrically driven air pump, in particular a method to manufacture a secondary air pump for a motor vehicle with an internal combustion engine, or such an electrically driven air pump.

Generic air pumps or fans are used for example as secondary air pumps or secondary ventilation fans to inject additional air into the exhaust gas channel of an internal combustion engine of a motor vehicle. This method minimizes the generation of nitrogen oxides or leads to a reduction in the content of carbon monoxides or hydrocarbons in the combustion residues before the exhaust gas reaches the catalyzer of the internal combustion engine. In the case of a secondary air supply, the exhaust gas channel is supplied with fresh air as immediately as possible behind the engine in order to eliminate the hydrocarbon compounds that are generated during the combustion process and the carbon monoxide. Because of the secondary air supply in the exhaust gas branch, an afterburning of the exhaust gas is practically set into motion, during the course of which the unburned carbon monoxides or hydrocarbons in the engine are afterburned, i.e., subsequently oxidized. In addition, the afterburning via a secondary air supply system increases the exhaust gas temperature so that the operating temperature required for a regulated catalyzer is reached prematurely. Higher temperatures in the exhaust gas branch permit the regulated catalyzer to thereby respond more quickly so that it is able to fulfill its task of eliminating harmful substances sooner during the driving cycle.

Due to the high nominal speed of secondary ventilation fans, which are typically in the range of 20,000 rpm, extremely high requirements for synchronism and thus for the quality of the counterbalancing process are placed on the fan and particularly on the electric motor driving the fan. The vibrations in the air pump that are generated due to imbalances are transmitted to the components that are connected to the air pump and thereby generate increased running noise. It can possibly be necessary to isolate the entire air pump mechanically vis-à-vis other components in order to avoid transmitting vibrations to the vehicle and especially to the passenger compartment.

In order to improve the smoothness of running of such an air pump, removing or applying material to a fan wheel of the pump mechanism is generally known as a means to balance the air pump for example.

An electrically driven air pump is known from EP 0 711 924 B1, which features a housing in which a pump mechanism is arranged on the one side and an electric motor is arranged on the other side. Covers close both the pump-side and motor-side of the housing of the air pump in EP 0 711 924 B1. The electric motor driving the pump mechanism is isolated to a large extent within the pump by means of two elastomer rings, which are supported between the electric motor and the pump housing. The electric motor in this prior art electrically driven air pump is counterbalanced with an installed pump wheel, in a built-in state, with a not yet closed pump side by placing balancing marks on a running wheel of the pump mechanism. Due to the fact that the electric motor is balanced in a built-in state with an installed pump wheel, cooperation of the electric motor with additional components of the air pump can be taken into consideration. Because of the balancing process on the installed electric motor, even though the running quality of such an air pump can be increased by the reduction in the vibrations occurring, manufacturing tolerances cannot be avoided from air pump to air pump, however.

SUMMARY OF THE INVENTION

The invention is based on the objective of creating a method to manufacture an electric air pump with reduced vibrations and therefore also inherently reduced running noise. It is also the objective of the present invention to make such an air pump available.

The objective on which the invention is based is attained by a method to manufacture an electrically driven air pump or by an electrically driven air pump.

The method in accordance with the invention to manufacture an electrically driven air pump improves the air pump known from the prior art with respect to its running quality. In the case of the manufacturing method in accordance with the invention, the air pump, which features a housing in which a pump mechanism with at least one fan wheel as well as an electric motor driving the at least one fan wheel are integrated, is counterbalanced with the electric motor already built into the housing via balancing in at least two planes that are spaced apart axially. Because of this two-plane balancing, the balance quality of the electrically driven air pump in accordance with the invention is clearly increased so that manufacturing tolerances can be further reduced in the running noise of the pump.

In the case of the method in accordance with the invention to manufacture an air pump, after assembly of the at least one fan wheel on the shaft of the electric motor, with an already built-in electric motor, the air pump is balanced by balancing on a fan wheel and additional balancing in a balancing plane that is spaced apart axially from the fan wheel.

The electrically driven air pump in accordance with the invention advantageously features a balancing plate in the area of the end of the drive shaft of the electric motor facing away from the pump mechanism.

In the case of the method in accordance with the invention to manufacture an electrically driven air pump, the air pump can be balanced via material removal, e.g., via pure mechanical material removal on the fan wheel or on the balancing plate. The balancing plate of the air pump in accordance with the invention is composed advantageously of a metal, which can be reduced in terms of its mass by mechanical removal ("gnawing off") so that the moment of inertia of the balancing plate or the moment of inertia of the fan wheel can be adapted to the requirements of the counterbalancing process.

In order to achieve a clearly increased degree of counterbalancing, the balancing plate is attached on the side of the shaft of the electric motor facing away from the pump mechanism. As a result, the two balancing planes possess a great axial distance from one another.

The electric motor of the air pump is isolated vibrationally from the pump housing via elastic means. This produces a further reduction in the vibrations of the driving motor on the pump housing. In the case of the method in accordance with the invention to manufacture an electrically driven air pump, when balancing the air pump, the balancing rpm and/or the manner of incorporating the balancing is coordinated with the natural frequency of the isolation means. Typically the air pump in accordance with the invention is counterbalanced in an rpm range that is clearly below the frequency of resonance of the isolation means. It is possible in this way to minimize the effect of the elastic coupling means between the electric motor and the pump housing on the running behavior of the air pump.

In addition, the elastic means to support the electric motor are embodied in such a way that the pump mechanism of the air pump is sealed vis-à-vis the motor part. As a result, the elastic means are advantageously embodied in the form of two elastomer rings that are spaced apart axially. In an advantageous embodiment of the air pump in accordance with the invention, the elastomer ring on the fan side has a sealing lip, which seals the pump mechanism of the air pump vis-à-vis the motor part.

At least one elastomer ring can feature means to support the torque of the driving motor so that the motor is securely fixed especially during its starting phase.

In an advantageous embodiment of the electrically driven air pump in accordance with the invention, elastomer rings are each arranged between the pole housing of the driving motor and the pump housing of the air pump. In an especially advantageous embodiment, the elastomer rings are arranged on the axial front sides of the pole housing of the driving motor. The elastomer rings are embodied in this case as axial-radial supporting rings so that the electric motor is fixed in both the axial direction as well as in the radial direction by the elastic supporting means.

The electrically driven air pump in accordance with the invention features a housing, which has a cover on the fan wheel side and a cover on the motor side. In the case of the method to manufacture an electrically driven air pump in accordance with the invention, the completely mounted air pump with covers that are not yet mounted can thus be completely counterbalanced in two planes. Imbalances, which are first yielded for example by installing the electric motor in the pump housing, can be eliminated to a large extent via the resulting complete balancing. Dispersion in the running quality of an air pump, which results from the mechanical isolation elements, can be minimized by the manufacturing method in accordance with the invention. In the case of the method in accordance with the invention, upon termination of the counterbalancing process the pump housing is completed and closed by a cover on the fan wheel side and a cover on the motor side.

The claimed method to manufacture an electrically driven air pump supplies an air pump, which guarantees extremely high smoothness of running due to its complete balancing in two planes. Because of the strong structure-borne noise isolation, which is achieved via the mechanical isolation of the electric motor and the additional complete counterbalancing in two planes that is conducted in an installed state, it also is possible to use the air pump in accordance with the invention without expensive isolations for the body mountings.

Additional advantages of the method in accordance with the invention or the air pump in accordance with the invention can be found in the following drawings as well as in the associated description of an exemplary embodiment of an air pump in accordance with the invention.

BRIEF DESCRIPTION OF THE DRAWINGS

An exemplary embodiment of an electrically driven air pump in accordance with the invention to compress combustion air is depicted in the drawing. This air pump as well as the method in accordance with the invention to manufacture such an air pump is explained in greater detail in the following description. The figures of the drawing, the description thereof as well as the claims focused thereon contain numerous features in combination. A person skilled in the art will also observe these features individually and combine them into additional, meaningful combinations.

The drawings show.

DETAILED DESCRIPTION

Figure 1:
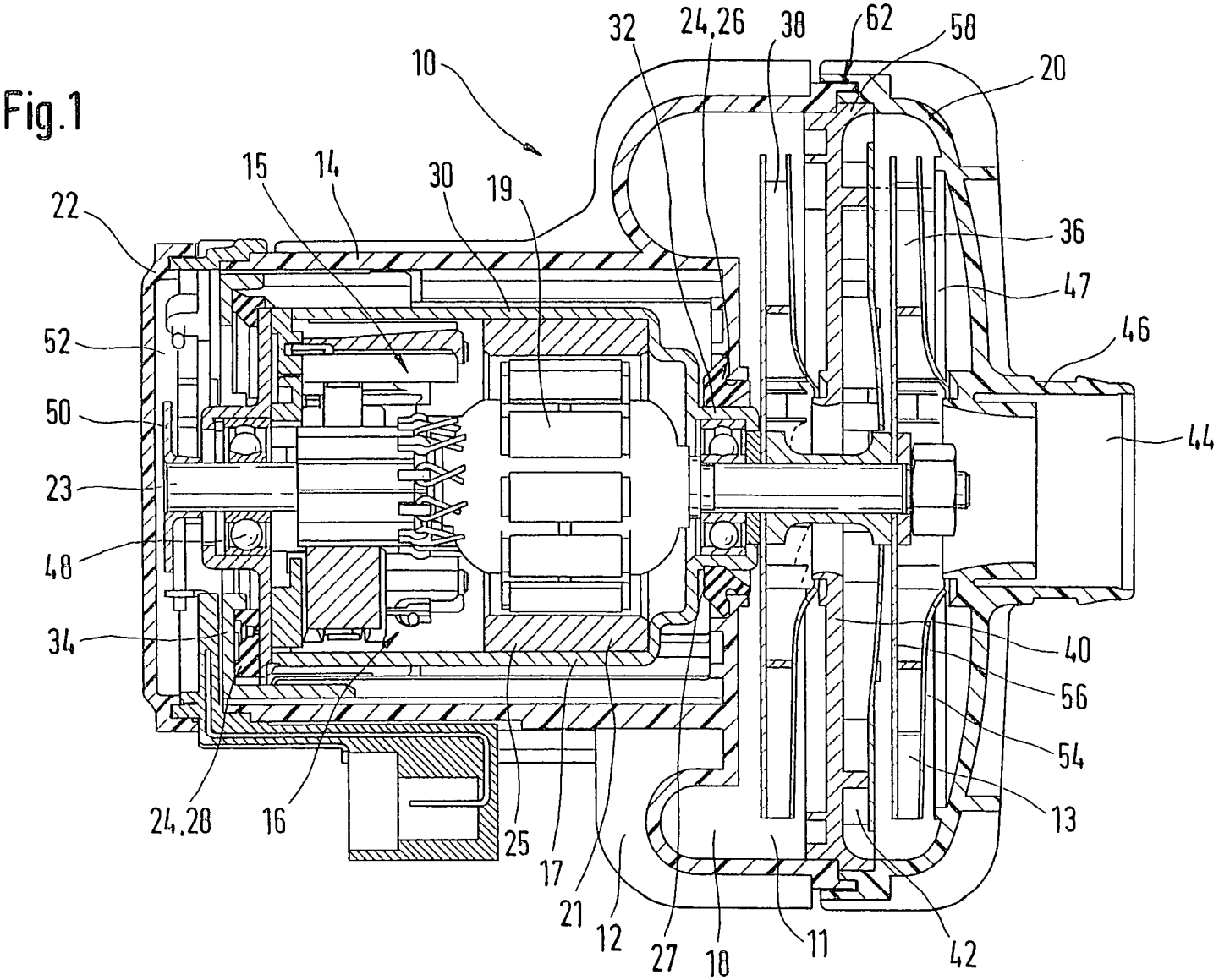
FIG. 1 A longitudinal section through an electrically driven air pump in accordance with the invention in an installed state.

FIG. 1 shows a longitudinal section through an exemplary embodiment of an electrically driven air pump 10 in accordance with the invention in an installed state. The air pump 10 includes a pump part 11 as well as a drive or motor part 15, which are surrounded by a housing 12. The pump part 11 is composed essentially of a pump mechanism 13 as well as corresponding inlet and outlet openings for the air that is to be conveyed. The pump housing 12 is embodied as essentially three parts in the exemplary embodiment in accordance with FIG. 1. In addition to a central housing part 14, which surrounds the electric motor 16 driving the air pump, the housing 12 features a cover 20 on the pump mechanism side as well as a cover 22 on the driving motor side. The cover 20 on the pump mechanism side has a central opening 44, though which the to-be-compressed air is inducted. The housing 12 of the air pump 10 in accordance with the invention is manufactured in an advantageous manner of a plastic.

The driving electric motor 16, which is embodied as an internal rotor in the exemplary embodiment in FIG. 1 and has at least one rotor 19 and a stator 21 surrounding the rotor, is introduced in the central housing part 14 of the air pump 10 in accordance with the invention. The stator 21 is realized by magnets 25 in the exemplary embodiment of the pump in accordance with the invention shown in FIG. 1. A pole housing 30 of the motor forms the motor housing 17 of the electric motor 16. Other motor types than the internal rotor depicted in the exemplary embodiment are also conceivable for the air pump in accordance with the invention, however. The electric motor 16 drives the pump mechanism 13 via a shaft 23 to compress the air.

The electric motor 16 is isolated from the housing 12 of the air pump via elastic means 24. In the exemplary embodiment in FIG. 1, elastomer rings 26 or 28 are used to dampen vibrations. The elastomer rings 26 or 28 are placed on the front sides of the pole housing 30 of the electric motor 16 between the pole housing 30 and the pump housing 12. The elastomer rings in this case are formed and introduced in such a way that there is both a radial as well as an axial support of the electric motor 16 in the pump housing. The isolation 28 on the motor side is embodied in terms of its shape so that there is a torque support of the electric motor 16 on the housing. Of course, the torque support can also be embodied on the elastomer ring 26 on the pump mechanism side or on both elastomer rings. In addition, the elastomer ring 26 on the pump mechanism side in particular has a sealing lip 27, which leads to the elastic means 24 for improving the smoothness of running of the air pump 10 in accordance with the invention also simultaneously serving as a sealing element between the motor part 15 and the pump mechanism 13 of the air pump in accordance with the invention. The elastomer ring 26 on the pump mechanism side is advantageously arranged in the area of an end shield 32 of the driving motor pointing to the pump mechanism 13.

After assembly of the motor 16, which is provided with the isolation rings 26 or 28, in the pump housing 12, a holding cover 34 is installed on the side of the motor housing 17 facing away from the pump mechanism 13. The holding cover 34 is pressed against the elastomer ring 28 and locked with the central housing part 14 of the pump housing 12. The electric motor 16 is fixed in the axial direction in this way.

The shaft 23 of the driving motor 16 of the air pump 10 in accordance with the invention is guided out of both axial ends of the motor housing 17 and on its one side (on the right side in FIG. 1) bears running wheels 36 or 38 of the pump mechanism 13. The pump mechanism 13 of the air pump in accordance with the invention as per the exemplary embodiment in FIG. 1 is designed to be two-stage. A guide wheel 40, which can be permanently connected with the housing 12 of the air pump, is arranged between the two running wheels 36 or 38 of the pump mechanism. The guide wheel 40 features structures in the form of channels 42, which make sure that the air conveyed radially from the first running wheel 36 to the outside is conveyed from the outer area of the first running wheel into the inner running wheel area of the second running wheel 38 so that an effective two-stage compression of the inducted air can occur. The compressed air that is guided radially by the second running wheel 38 to the outside is conveyed into an annular air guidance channel 18 running in the circumferential direction of the housing 12 of the air pump 10 and the diameter of the air guidance channel increases in the circumferential direction of the pump housing 12. This air guidance channel 18 (volute) terminates in a connection of the air pump on the pressure side (not depicted further in FIG. 1).

The air pump 10 in accordance with the invention is not limited to a two-stage pump mechanism 13. Additional or even fewer pump stages can of course also be used in a pump in accordance with the invention. In the case of a multi-stage pump mechanism, each additional running wheel is also allocated to another guide wheel, which conveys the air from the previously connected running wheel that is conveyed radially to the outside into the radial interior area of the subsequently connected running wheel.

The cover 20 on the pump mechanism side is embodied in such a way that structures 47 are formed on its inner side, i.e., the side facing the first running wheel 36 of the pump mechanism 13, and these structures prevent the air that is compressed via the first running wheel from flowing back into the induction area of the pump mechanism.

The housing of the air pump is closed on the pump mechanism side via a cover 20, which features a central opening 44 for the induction of the to-be-compressed air. The central opening 44 in the cover 20 of the pump housing 12 is embodied as a connecting piece 46 in the exemplary embodiment in FIG. 1, and this connecting piece makes it possible to quickly and easily install corresponding connecting means, such as hoses, on the pump in accordance with the invention.

The pump housing 12, the guide wheel 40 of the pump mechanism 13 as well as the cover 20 on the pump mechanism side are connected to one another near the end of the method in accordance with the invention to manufacture an electrically driven air pump. All Techniques known to appropriate persons skilled in the art can be used as connecting techniques in this case.

Also on the side of the motor housing 17 facing away from the pump mechanism 13, the drive shaft 23 of the electric motor 16 is guided out of the motor housing 17 via the shaft bearing 48 located there. In the area of the end of the drive shaft 23 facing away from the pump mechanism 13, a balancing plate 50 is installed on the drive shaft 23 of the motor 16 and it is connected in a rotationally secured manner with the drive shaft. This balancing plate 50 can be manufactured of metal, e.g., a sheet metal, and has a diameter that is typically less than the diameter of the rotor 19 of the driving motor 16. The balancing plate 50 is connected in a rotationally secured manner with the drive shaft 23 using a fastening method known to the person skilled in the art. Balancing marks, e.g., via material removal, can be placed on the balancing plate 50 to compensate for the imbalance of the air pump 10 in accordance with the invention. After assembly of the air pump has taken place, a cover 22 closes the end of the housing 12 of the air pump 10 in accordance with the invention that faces away from the pump mechanism 13.

In the case of the method in accordance with the invention to manufacture an electrically driven air pump, the mounted driving motor 16 is provided with the isolation rings 26 or 28 to begin with. The electric motor 16 as such can already be pre-balanced so that a first balancing process can be performed, e.g., via material removal or material application on the motor shaft or on the rotor or even on the armature of the motor. Alternatively, a pre-balancing of the electric motor 16 as such can be dispensed with so that just the still-to-be-described counterbalancing of the air pump 10 with the mounted electric motor 16 and the mounted pump wheel 36 or 38 needs to be performed. The pre-balanced electric motor 16 is introduced into the pump housing 12 through an opening 52 in the pump housing 12 that faces away from the pump mechanism 13 and secured by locking the holding cover 34 on the housing in an axial and radial direction. In doing so, the locking of the holding cover 34 shall be selected in such a way that the elastomer rings 26 or 28 are pressed against the inner side of the pump housing 12 under a specific initial stress. Then the running wheel 38, the guide wheel 40 and the running wheel 36 are mounted on the end of the drive shaft 23 of the electric motor 16 that is on the pump mechanism side.

In the case of this method to manufacture an electrically driven air pump 10, it is provided in accordance with the invention that the air pump be balanced in the case of a built-in electric motor 16 with an installed pump mechanism 13.

Figure 2:
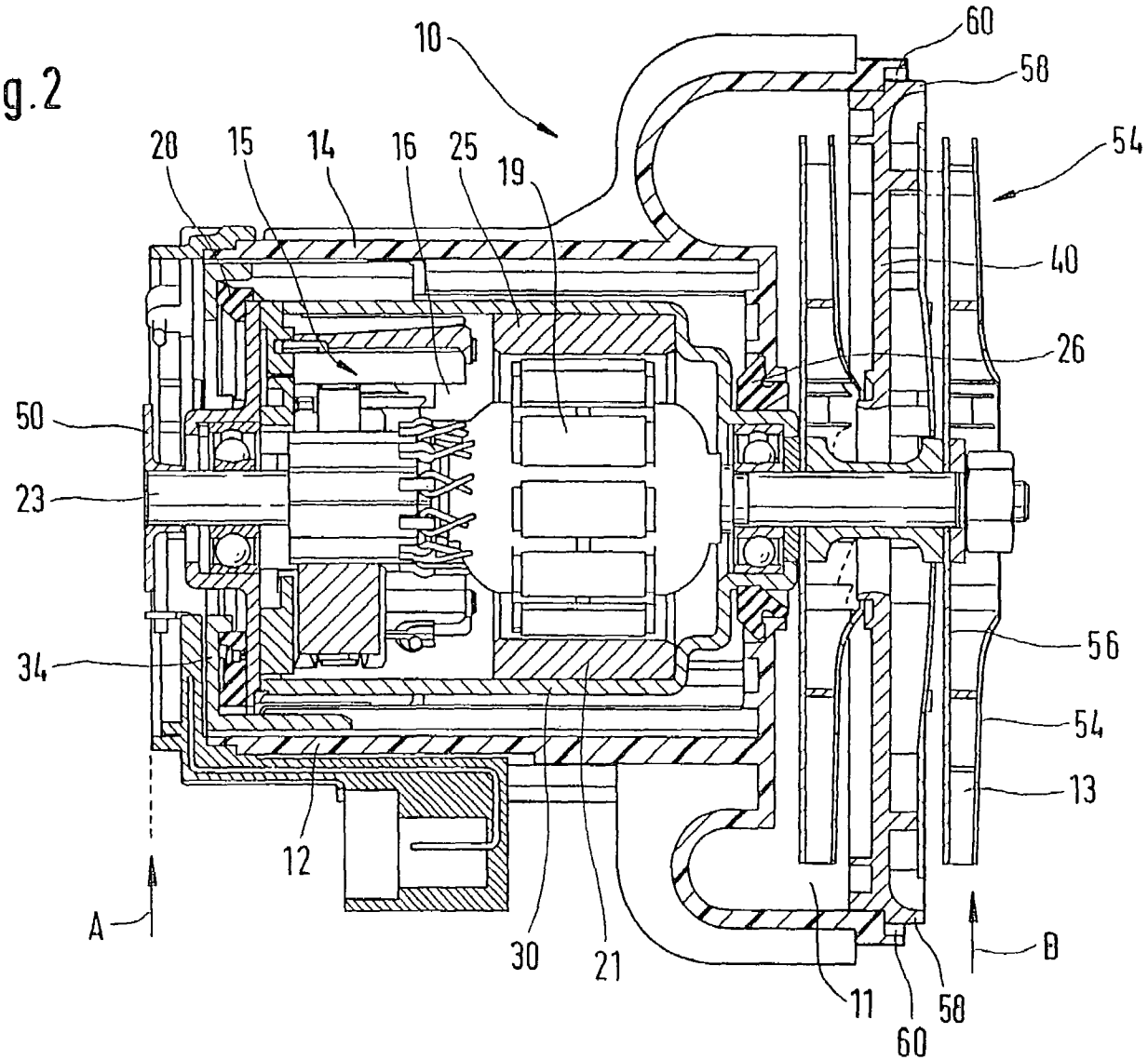
FIG. 2 A longitudinal section through an air pump in accordance with FIG. 1 with the covers removed on the fan side and the motor side.

FIG. 2 shows the pump in accordance with the invention with a built-in electric motor 16 as well as a mounted pump mechanism 13 as it is used for counterbalancing, e.g., in a balancing machine. The balancing process is performed consecutively or in parallel in two balancing planes A or B arranged essentially perpendicular to the drive shaft 23 of the air pump 10. Balancing plane A is formed by the balancing plate 50 on the end of the drive shaft 23 facing away from the pump mechanism 13. The second balancing plane B is formed in the exemplary embodiment in FIG. 2 by the cover plate 54 of the running wheel 36 of the pump mechanism 13 of the air pump 10 in accordance with the invention. Alternatively, balancing plane B can also coincide with the base plate 56 of the running wheel 36.

The air pump 10 in accordance with the invention is advantageously balanced via the placement of counterbalancing marks in one or both balancing planes. To do this, material can be "gnawed off" the balancing plate 50 or the cover plate 54. The balancing rpm and the manner of incorporating the balancing is coordinated in this case with the natural frequency of the isolation of the electric motor 16 via the elastic means 24. In particular, counterbalancing the air pump in accordance with the invention is prohibited in the rpm range of the natural frequency of the isolation means 24.

A material removal by vaporizing by means of a high-intensive light or laser beam is another possible method for placing counterbalancing marks in the case of the method in accordance with the invention. In addition, it is also possible to realize counterbalancing marks by applying adhesive dots, particularly on one fan wheel or the balancing plate.

After balancing has taken place, the pump housing 12 is completed via assembly of the cover 22 on the motor side or the cover 20 on the pump mechanism side. When assembling the cover 20 on the pump mechanism side, the guide wheel 40 is fixed axially and radially between the housing part 14 and the cover 20 so that it is secured against twisting. For example, the guide wheel 40 can be fit, on its outer circumference 58, into corresponding recesses 60 of the central housing part 14 of the pump housing 12 or into recesses 62 of the cover 20 on the pump mechanism side and clamped in by installing the cover 20. A plurality of possibilities is available to the person skilled in the art to fasten the cover 20 or 22 that completes the pump housing 12. Mentioned here as possible fastening methods in part and by no means definitively are clamping, screwing, riveting, bonding, ultrasonic welding or friction welding.

Because of the complete fan balancing in two planes, a clear improvement in the smoothness of running of the air pump in accordance with the invention can be achieved in the case of an air pump that is already mounted to a large extent. In particular, the imbalances that are caused first by coupling effects of the built-in driving motor as well as the vibrations occurring on the basis of the mechanical isolation of the electric motor via the elastic means can be summarily corrected so that the manufacturing tolerances with respect to vibrations and running noise can be kept within narrow limits. This makes it possible in an advantageous manner that the air pump in accordance with the invention can be used for installation in a car body without expensive isolation.

The air pump in accordance with the invention is not limited to the exemplary embodiments depicted in the figures.

In particular, the air pump in accordance with the invention is not limited to the use of a two-stage pump mechanism.

The method in accordance with the invention to manufacture an electrically driven air pump is not limited to the mechanical removal of mass on the fan wheel or the balancing plate. In addition to the application of balancing masses, a melting off of material to improve the balancing quality, particularly optically induced melting off is also conceivable, for example.

The invention claimed is:

1. Method to manufacture an electrically driven air pump (10), wherein the air pump (10) features a housing (12), in which a pump mechanism (13) with at least one fan wheel (36, 38) as well as an electric motor (16) driving the at least one fan wheel (36, 38) are arranged, characterized in that the air pump (10) is counterbalanced with the electric motor (16) built into the housing (12) via balancing in at least two planes (A, B) that are spaced apart axially.

2. Method to manufacture an electrically driven air pump according to claim 1, characterized in that after assembly of the at least one fan wheel (36, 38) on a shaft (23) of the electric motor (16), with a built-in electric motor (16), the air pump (10) is balanced by balancing on a fan wheel (36, 38) and balancing on a balancing plate (50) that is spaced apart axially from the fan wheel (36, 38).

3. Method to manufacture an electrically driven air pump according to claim 2, characterized in that the air pump (10) is balanced via material removal on at least one fan wheel (36, 38) and/or material removal on the balancing plate (50).

4. Method to manufacture an electrically driven air pump according to claim 1, characterized in that the balancing plate (50) is attached on the side of the shaft (23) of the electric motor (16) facing away from the pump mechanism (13).

5. Method to manufacture an electrically driven air pump according to claim 1, characterized in that the electric motor (16) is isolated from the pump housing (12) via elastic means (24).

6. Method to manufacture an electrically driven air pump according to claim 5, characterized in that when balancing the air pump (10), the balancing rpm and/or the manner of incorporating the balancing is coordinated with the natural frequency of the elastic means (24).

7. Method to manufacture an electrically driven air pump according to claim 1, characterized in that after counterbalancing the air pump (10), the pump housing (12) is closed by a cover (20) on the fan wheel side and a cover (22) on the motor side.

8. Method to manufacture an electrically driven air pump according to claim 1, wherein the air pump is a secondary air pump (10) for a motor vehicle with an internal combustion engine.

* * * * *